US006422274B1

(12) United States Patent
Chiang

(10) Patent No.: US 6,422,274 B1
(45) Date of Patent: Jul. 23, 2002

(54) WOOD PLANING MACHINE

(76) Inventor: Pei-Lieh Chiang, No. 12, Nan-Ping Rd, Nan Dist., Taichung City (TW)

( * ) Notice: Subject to any disclaimer, the term of this patent is extended or adjusted under 35 U.S.C. 154(b) by 0 days.

(21) Appl. No.: 09/886,347

(22) Filed: Jun. 20, 2001

(30) Foreign Application Priority Data

May 15, 2001 (TW) ..... 090207903

(51) Int. Cl.[7] ..... B27C 1/100
(52) U.S. Cl. ..... 144/129; 144/117.1
(58) Field of Search ..... 144/114.1, 116, 144/117.1, 129, 130; 74/89.13, 89.15, 640, 642

(56) References Cited

U.S. PATENT DOCUMENTS 6,135,177 A 10/2000 Chiang ..... 144/129

FOREIGN PATENT DOCUMENTS

GB 25351 * 1/2000 ..... 144/129

* cited by examiner

*Primary Examiner*—W Donald Bray
(74) *Attorney, Agent, or Firm*—Christie, Parker & Hale, LLP

(57) ABSTRACT

A planing machine includes a support bed disposed within a machine body. A rod unit is mounted on the machine body, and is operably associated with the bed such that rotation of the rod unit results in movement of the bed within the machine body. A slide element is disposed slidably on the rod unit, and carries first and second bevel gears thereon. A toothed driving wheel is disposed adjacent to the slide element. The bevel gears are coupled to the rod unit for co-rotation therewith. The slide element is movable on the rod unit to a first position, where the first bevel gear meshes with and is driven by the driving wheel to permit the rod unit to rotate in a first direction, and to a second position, where the second bevel gear meshes with and is driven by the driving wheel to permit the rod unit to rotate in a second direction that is opposite to the first direction.

2 Claims, 13 Drawing Sheets

WOOD PLANING MACHINE

CROSS-REFERENCE TO RELATED APPLICATION

This application claims priority of Taiwan Application No. 90207903, filed on May 15, 2001.

BACKGROUND OF THE INVENTION

1.Field of the Invention

The present invention relates to a wood planing machine, more particularly to a wood planing machine with a height adjustment mechanism that is adapted to be operated manually, mechanically and externally of a machine body with ease.

2. Description of the Related Art

Referring to FIGS. 1 to 4, a wood planing machine 10 according to U.S. Pat. No. 6,135,177 is shown to include a machine body 11 with two opposite side walls 111, and a cutter unit (not shown) mounted between the side walls 111. A workpiece support bed 13 is movably disposed in the machine body 11 between the side walls 111 and below the cutter unit (not shown), and is movable relative to the latter. A holding seat 15 is suspended in the machine body 11 below the bed 13 and between the side walls 111. The holding seat 15 includes a tubular body 151 formed with an upright passage 152 therethrough, and a radial pinion-mounting hole 155 in communication with the passage 152. A coupling member 14 is secured to a bottom side of the bed 13, and has a fixed vertical rack 141 that extends between upper and lower ends thereof. The coupling member 14 extends slidably through the passage 152 in the holding seat 15. A drive shaft 16 has a first coupling end 162 mounted rotatably on the tubular body 151 and extending across the pinion-mounting hole 155. A turning rod unit 17 is mounted on the machine body 11, and is coupled to a second coupling end 164 of the drive shaft 16 via a pair of gears 171,163. A pinion 161 is disposed in the pinion-mounting hole 155 of the holding seat 15, and is fixed on the first coupling end 162 of the drive shaft 16 for meshing with the vertical rack 141 in such a manner that rotation of the rod unit 17 results in vertical movement of the bed 13 toward and away from the cutter unit (not shown)

Manual turning of the rod unit 17 in order to move the support bed 13 in the machine body 11 is tiresome. The situation is aggravated in case the support bed 13 is relatively large and heavy.

SUMMARY OF THE INVENTION

Therefore, the object of this invention is to provide a wood planing machine with a turning rod unit which is operable manually and mechanically and which can overcome the aforementioned drawbacks that are associated with the use of the prior art wood planing machine.

Accordingly, a wood planing machine of the present invention includes a machine body, a workpiece support bed, and a height adjustment mechanism. The workpiece support bed is disposed movably in the machine body. The height adjustment mechanism includes a bed-turning rod unit, a slide element, a transmission device, and first and second bevel gears. The rod unit is mounted on the machine body and is operably associated with the support bed in such a manner that rotation of the rod unit results in movement of the support bed within the machine body. The slide element is disposed slidably on the rod unit, has a pair of spaced apart gear-holding arms. The slide element is slidable along the rod unit between first and second positions. The transmission device is mounted on the machine body, and has a toothed driving wheel exposed therefrom disposed adjacent to the slide element. The first and second bevel gears are mounted respectively on the gear-holding arms of the slide element such that the first and second gears are disposed on opposite sides of the driving wheel. The first and second bevel gears are coupled to the rod unit so as to be co-rotatable therewith. The slide element is movable to the first position, where the first bevel gear meshes with and is driven by the driving wheel to permit the rod unit to rotate in a first direction, and to the second position, where the second bevel gear meshes with and is driven by the driving wheel to permit the rod unit to rotate in a second direction opposite to the first direction.

Since movements of the workpiece support bed relative to the cutter unit can be done manually and mechanically, the aforesaid drawbacks encountered by the use of the prior art wood planing machine can be eliminated.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
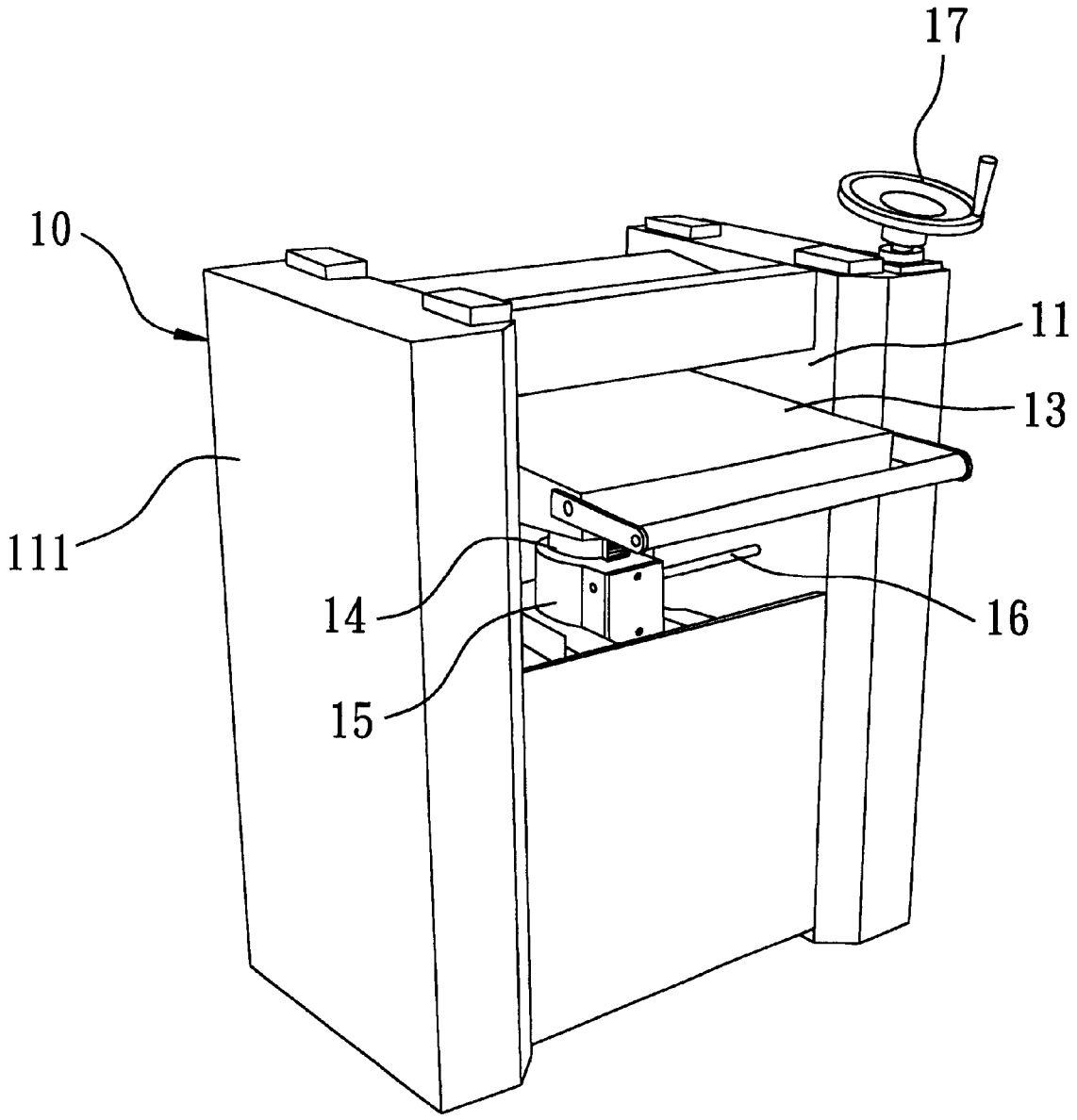
FIG. 1 PRIOR ART
FIG. 1 is a perspective view of a wood planing machine according to U.S. Pat. No. 6,135,177.
Figure 2:
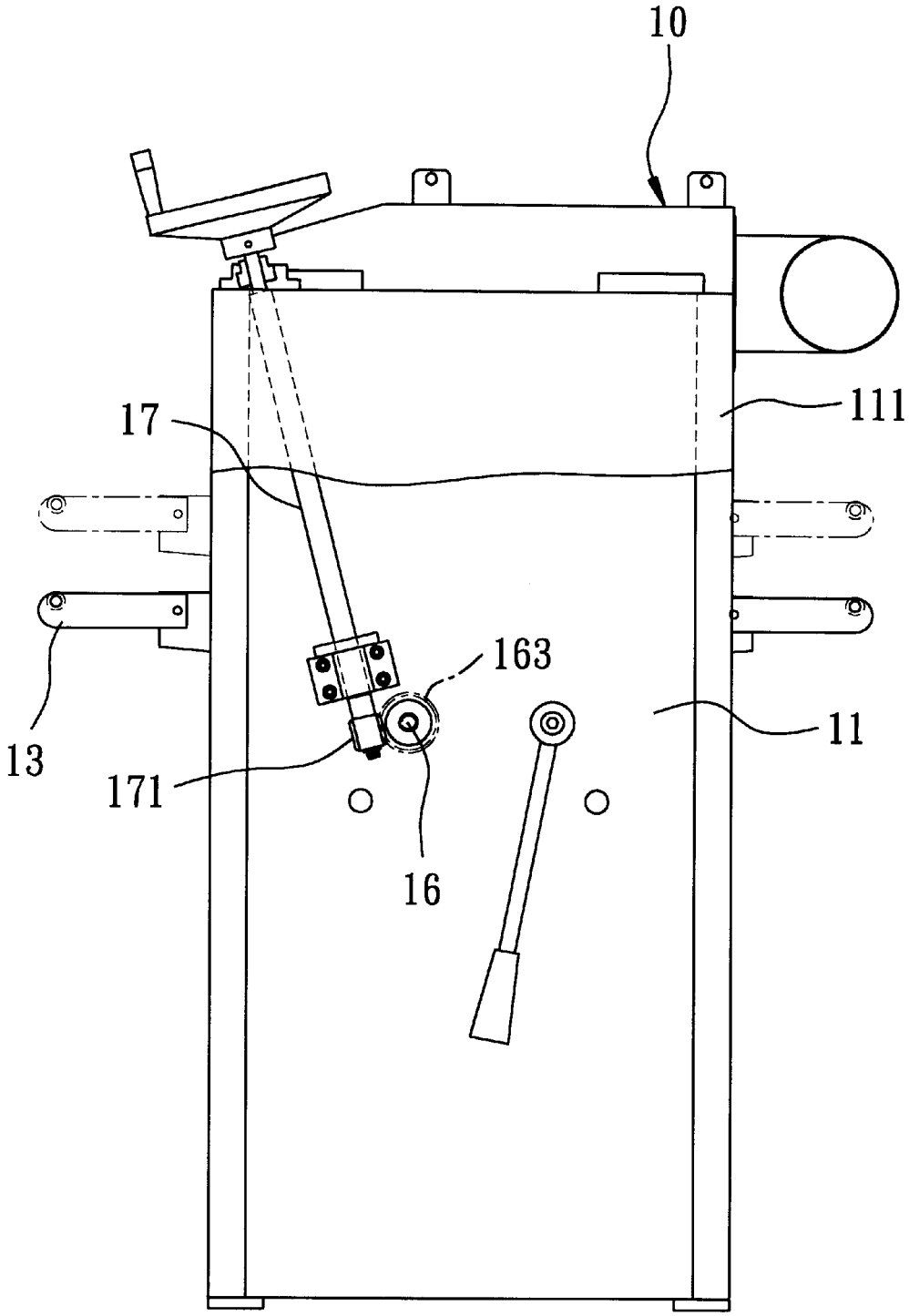
FIG. 2 PRIOR ART
FIG. 2 is a fragmentary partly cutaway side view of the wood planing machine shown in FIG. 1.
Figure 3:
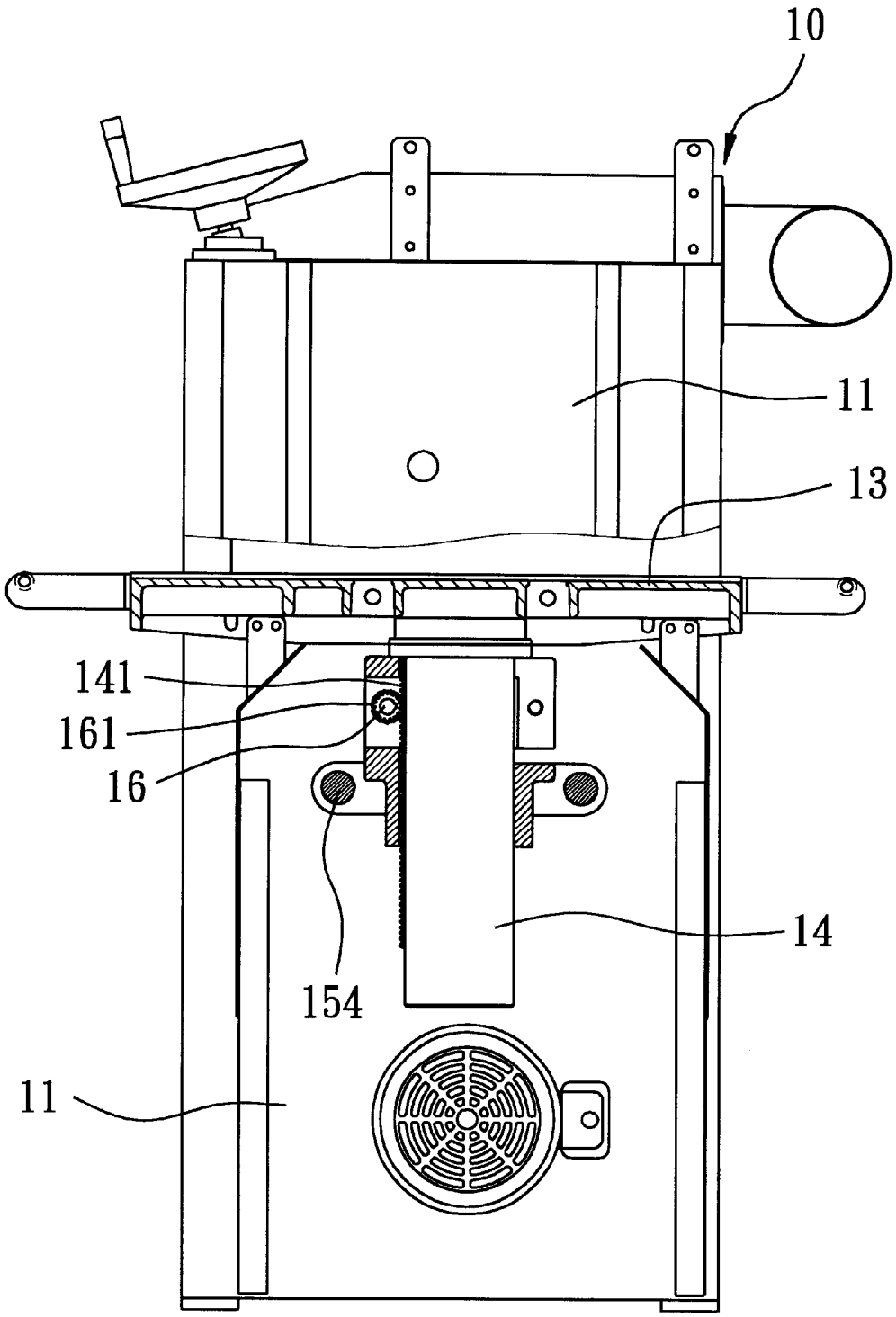
FIG. 3 illustrates how a turning rod unit is actuated in order to adjust the height of a workpiece support bed relative to a cutter unit in the wood planing machine of FIG. 1.
Figure 4:
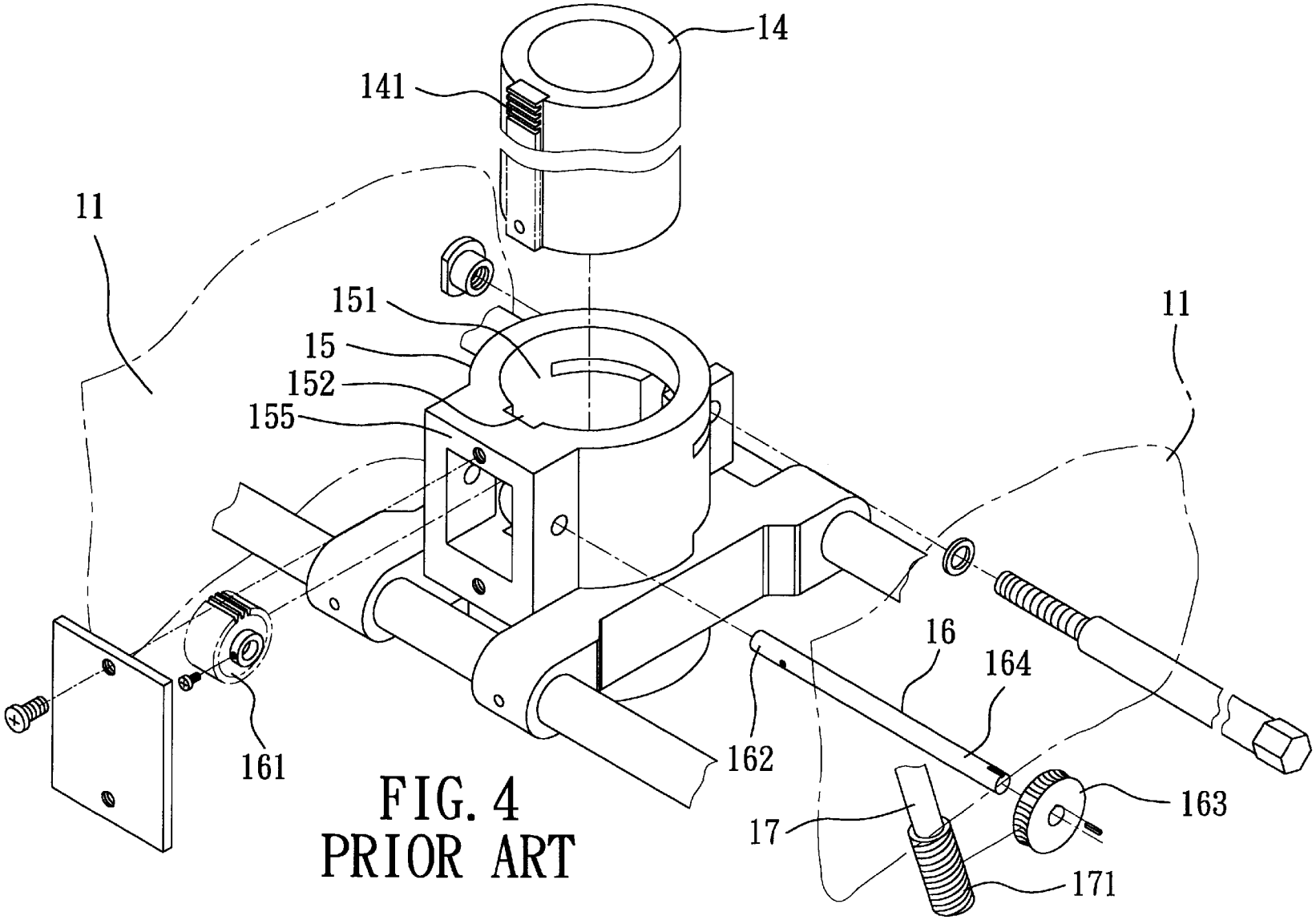
FIG. 4 PRIOR ART
FIG. 4 is an exploded perspective view of a height adjustment mechanism employed in the in the wood planing machine of FIG. 1.

Before the present invention is described in greater detail with reference to the following preferred embodiments, it should be noted that same reference numerals have been used to denote similar elements throughout the specification.

Figure 5:
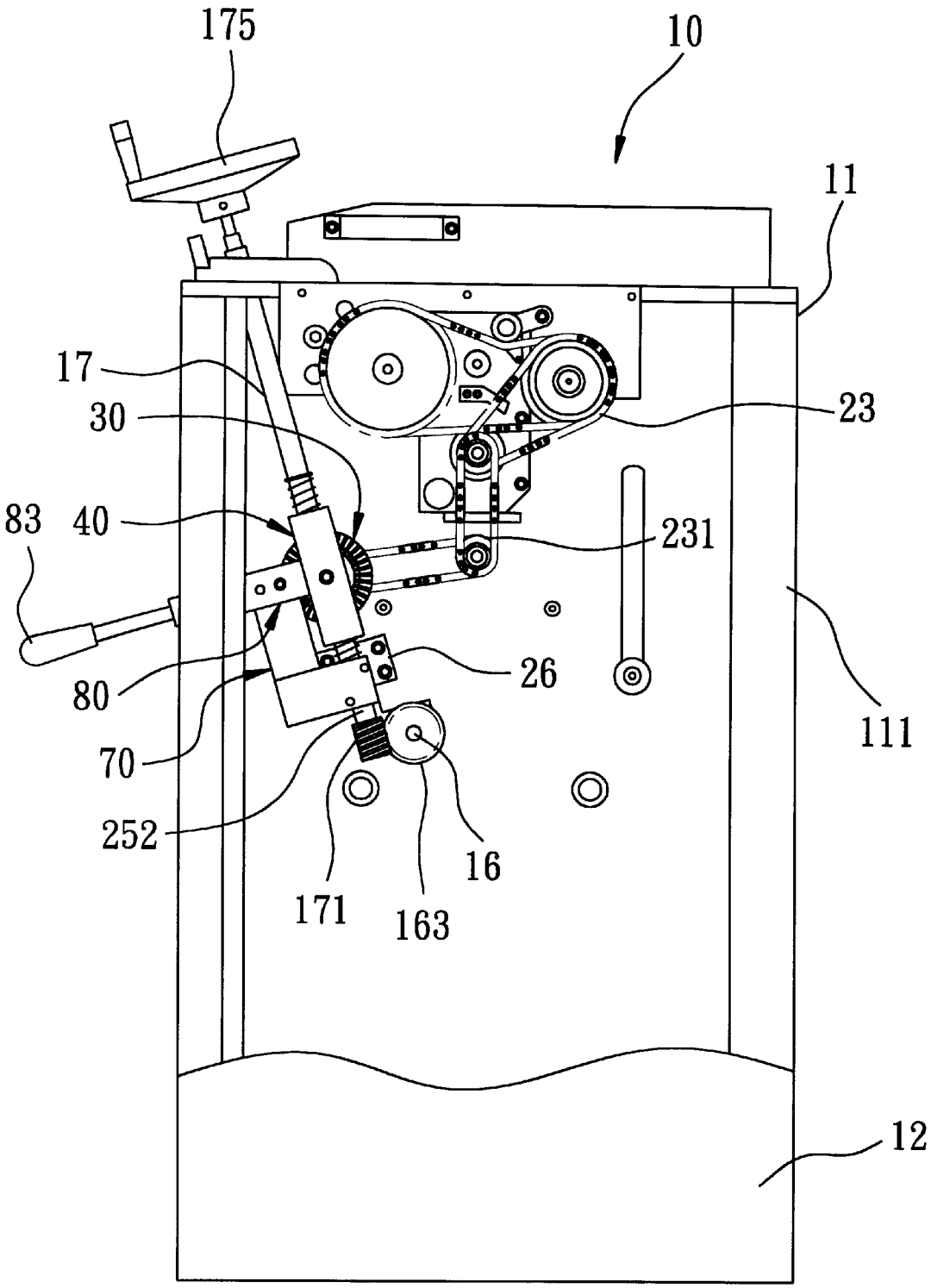
FIG. 5 is a fragmentary partly cutaway side view of the preferred embodiment of a wood planing machine according to the present invention.
Figure 6:
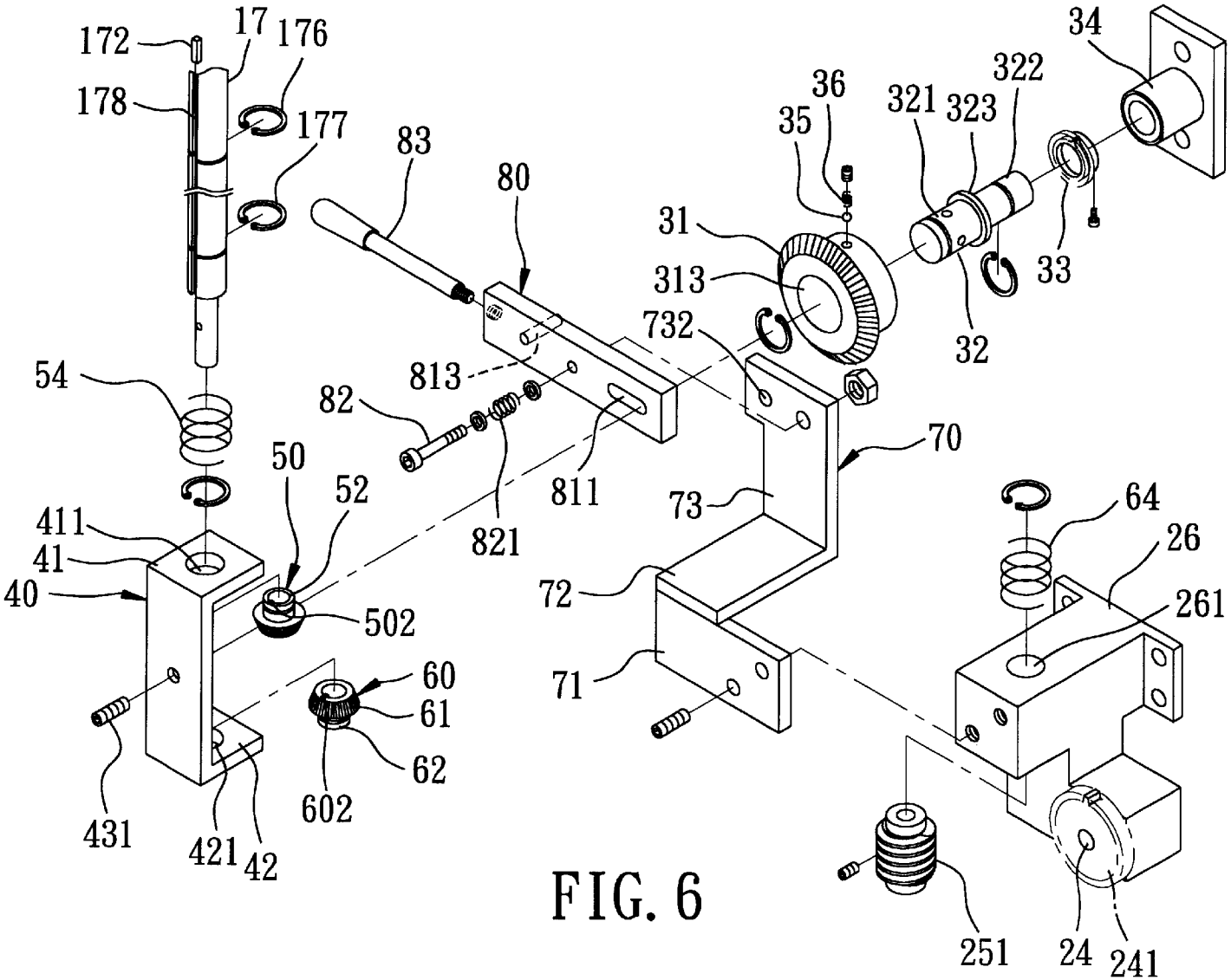
FIG. 6 is an exploded perspective view of a height adjustment mechanism employed in the preferred embodiment.
Figure 7:
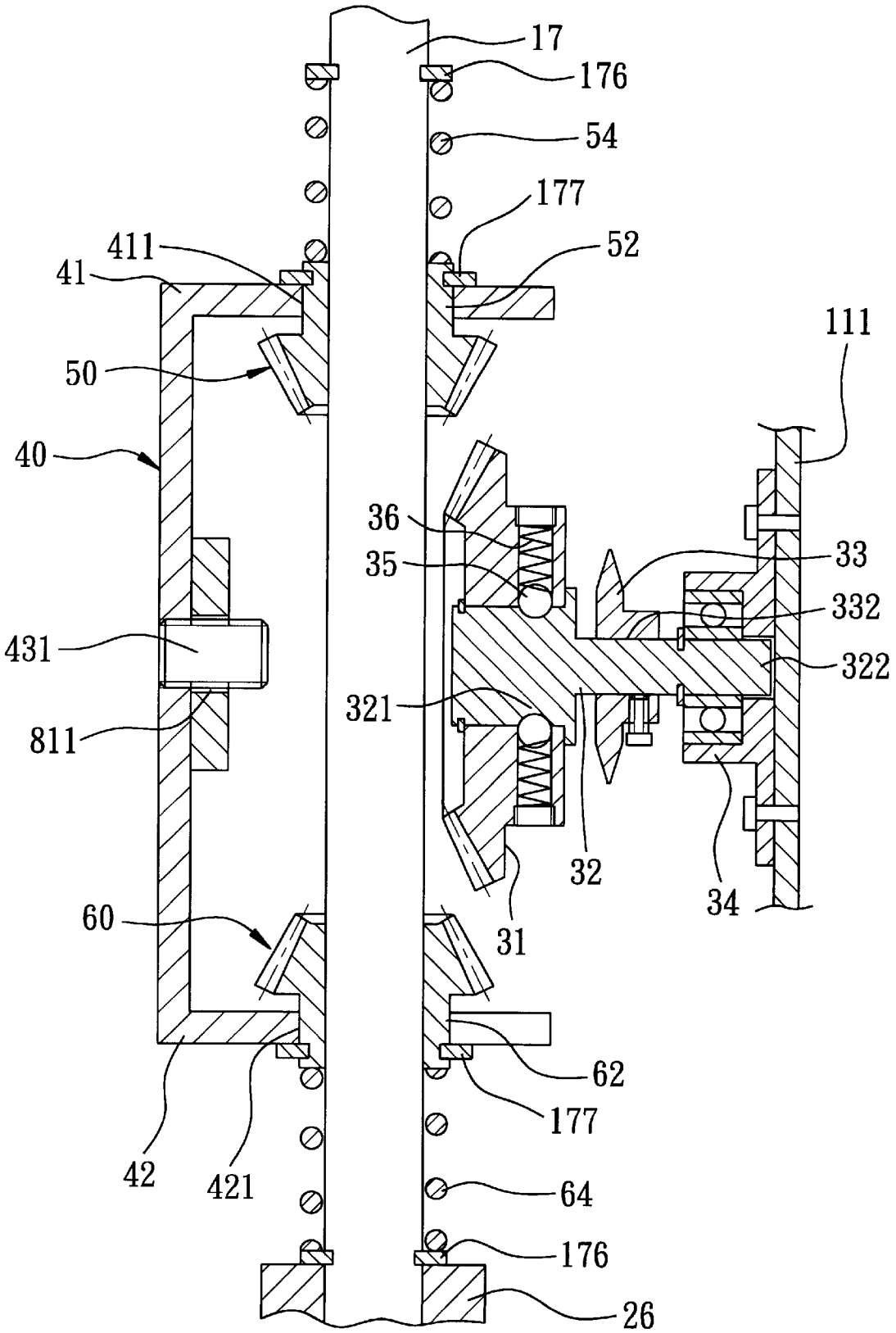
FIG. 7 is a fragmentary sectional side view of the preferred embodiment, illustrating an assembled configuration of the height adjustment mechanism in a normal position.

Referring to FIGS. 5, 6 and 7, the preferred embodiment of a wood planing machine 10 according to the present invention is shown to include a machine body 11, a cutter unit (not shown), a workpiece support bed 13 (see FIG. 1), a holding seat 15 (see FIG. 1), a bed-turning rod unit 17 (see FIG. 1), and a height adjustment mechanism.

Since the structural relations among the cutter unit, the workpiece support bed, the holding seat, the rod unit 17 and the machine body 11 are the same as those disclosed in the aforementioned U.S. Patent, a detailed description of these components is omitted herein for the sake of brevity. The present invention is related to improvements upon the height adjustment mechanism which further includes a slide element 40, a transmission device 23, first and second bevel gears (50,60), a lever-mounting seat 70, and an operating lever 80.

As illustrated, the machine body 11 has opposite side walls 111 that are spaced apart from each other. Two exterior walls 12 are mounted on the machine body 11 respectively outboard to the side walls 111 so as to conceal the side walls 111 and to enhance aesthetic appeal of the machine body 11.

A rod-holding seat 26 is fixed externally on the right side wall 111 of the machine body 11, and has a rod retaining hole 261 to permit extension of a lower end of the rod unit 17 therethrough, and a shaft hole 260 which permits extension of the drive shaft 16 (see FIG. 1) such that a gear 163 can be fixed thereon. The rod unit 17 is operably associated with the support bed 13 (see FIG. 1) via the worm gear 171 that meshes with the gear 163 in such a manner that rotation of the rod unit 17 results in movement of the support bed 13 within the machine body 11. Preferably, a turning wheel 175 is fixed on an upper end of the rod unit 17 to facilitate turning the rod unit 17 about an axis.

The slide element 40 is disposed slidably on the rod unit 17, and has spaced apart upper and lower gear-holding arms 41,42. The slide element 40 is slidable along the rod unit 17 between first and second positions.

The transmission device 23 is mounted on the machine body 11, and has a toothed driving wheel 31 exposed from the right side wall 111 such that the toothed driving wheel 31 is disposed adjacent to the slide element 40.

The first and second bevel gears 50,60 are mounted respectively on the upper and lower gear-holding arms 41,42 of the slide element 40 such that the first and second gears 50, 60 are disposed on opposite sides of the driving wheel 31. The bevel gears 50,60 are further coupled to the rod unit 17 so as to be co-rotatable therewith.

Figure 10:
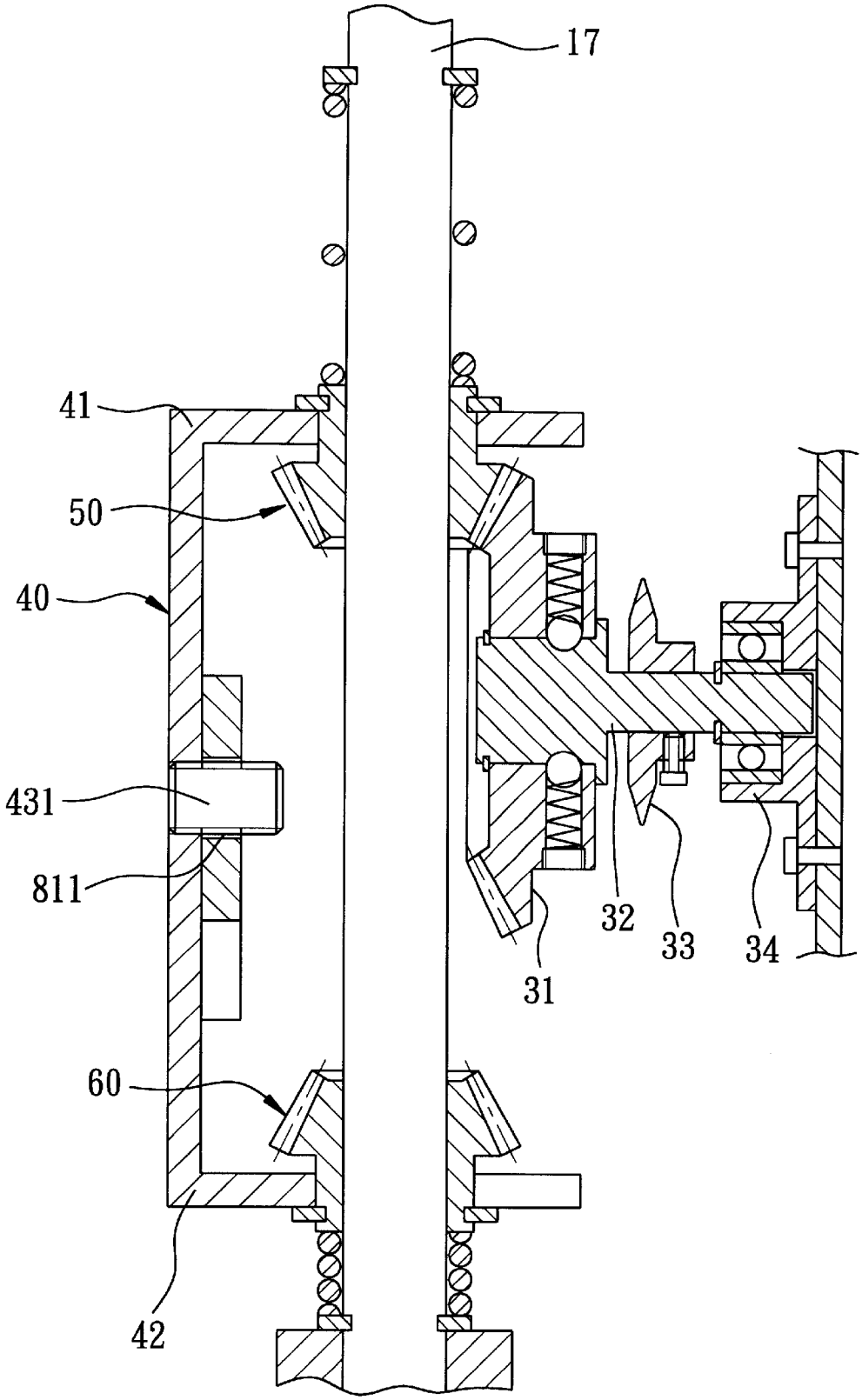
FIG. 10 is a fragmentary partly sectional view of the preferred embodiment, illustrating how the rod unit is rotated in a first direction due to upward movement of the slide element on the rod unit.
Figure 11:
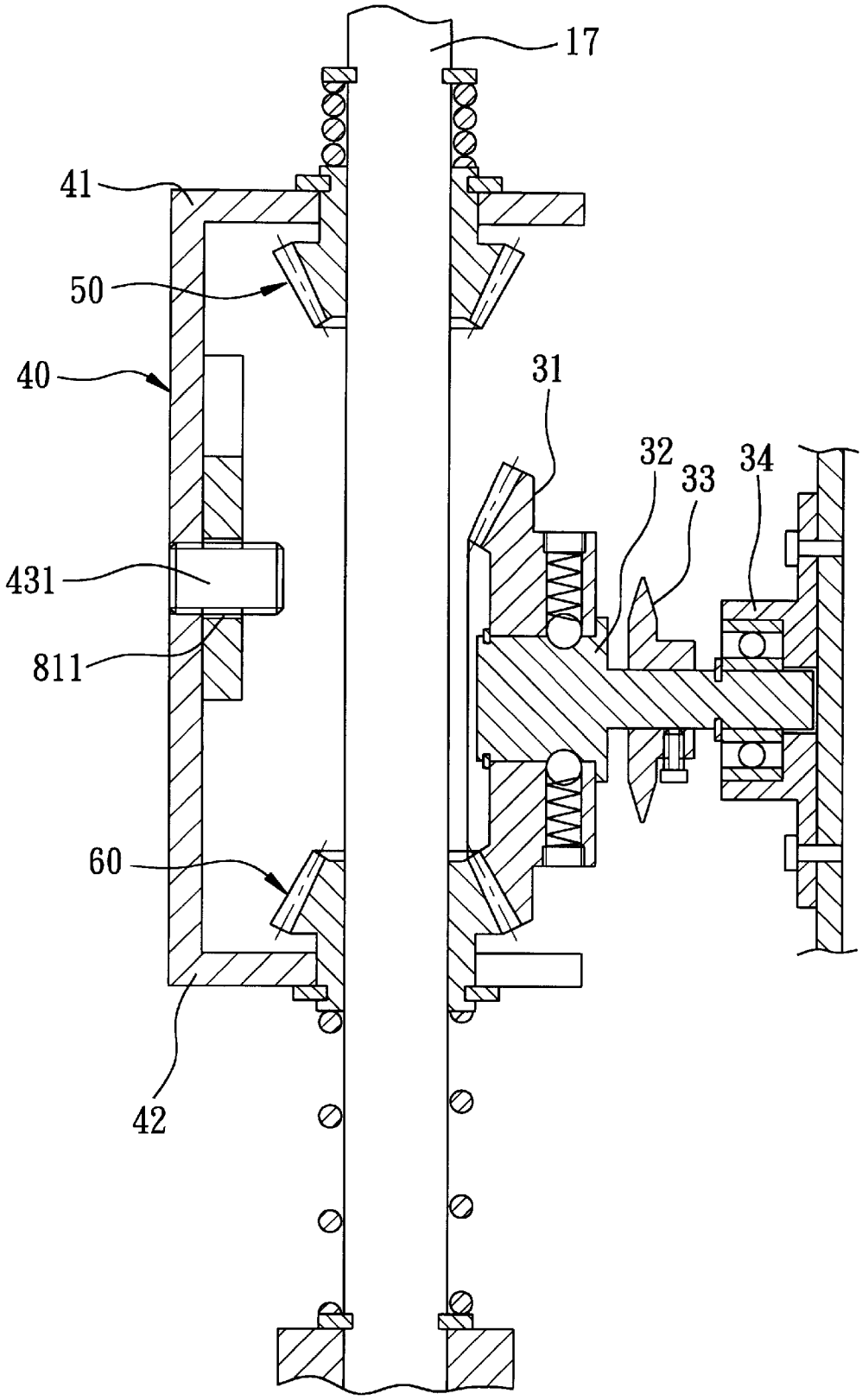
FIG. 11 is a fragmentary partly sectional view of the preferred embodiment, illustrating how the rod unit is rotated in a second direction due to downward movement of the slide element on the rod unit.

The slide element 40 is movable to the first position, as best shown in FIG. 10, where the first bevel gear 50 meshes with and is driven by the driving wheel 31 to permit the rod unit 17 to rotate in a first direction, and to the second position, as best shown in FIG. 11, where the second bevel gear 60 meshes with and is driven by the driving wheel 31 to permit the rod unit 17 to rotate in a second direction opposite to the first direction.

In the preferred embodiment, the slide element 40 is formed with an engaging tongue 431 disposed between the gear-holding arms 41,42. The lever-mounting seat 70 includes a lower plate portion 71 fixed on the rod-holding seat 26, an upper plate portion 73, and an intermediate plate portion 72 between the lower and upper plate portions 71,73. The upper plate portion 73 of the lever-mounting seat 70 is formed with a retention hole 732 therein. The operating lever 80 is pivoted to the seat 70 by a rivet 82, and has a protrusion 813 projecting toward the retention hole 732 and a slot 811 for receiving the engaging tongue 431 of the slide element 40 therein.

Figure 8A:
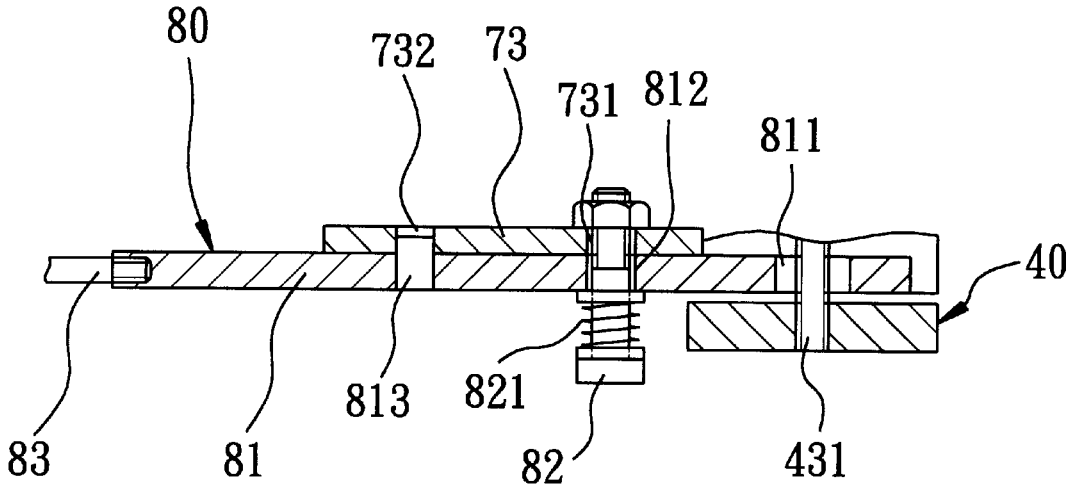
FIGS. 8 (A) and 8 (B) respectively show sectional and side views illustrating interconnection among a lever, a lever-mounting seat and a slide element of the height adjustment mechanism employed in the preferred embodiment.
Figure 8B:
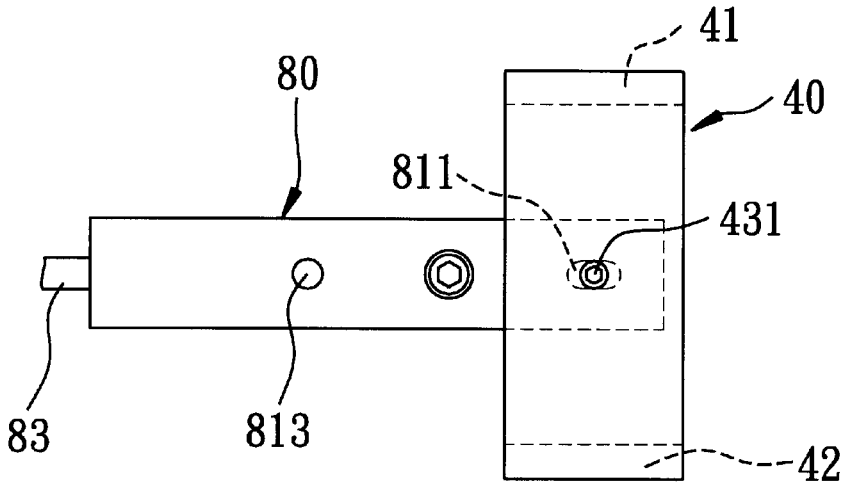
Figure 9A:
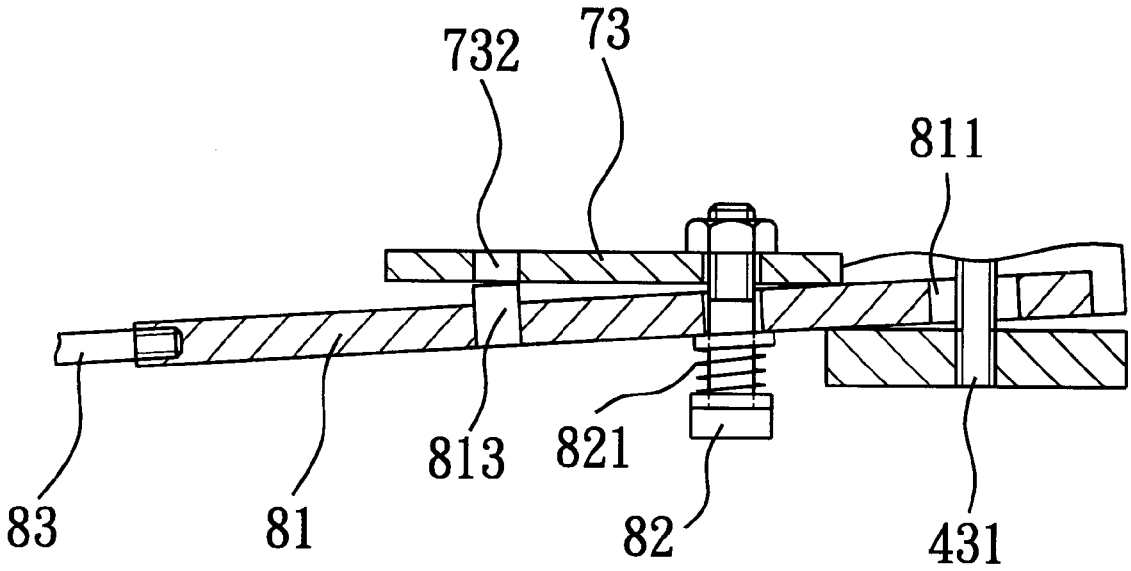
FIGS. 9 (A), 9 (B) and 9 (C) respectively show how the lever of the preferred embodiment is actuated after release from the lever-mounting seat to move the slide element upward and downward along a rod unit.
Figure 9B:
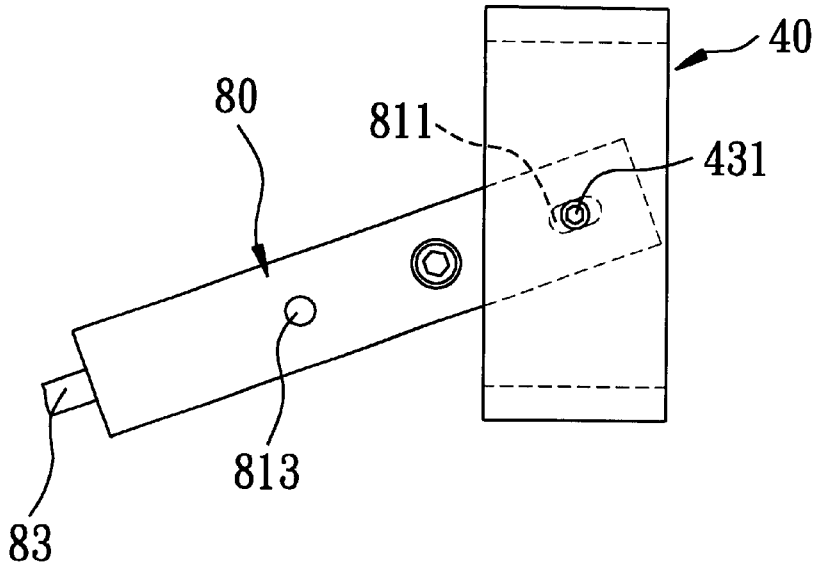
Figure 9C:
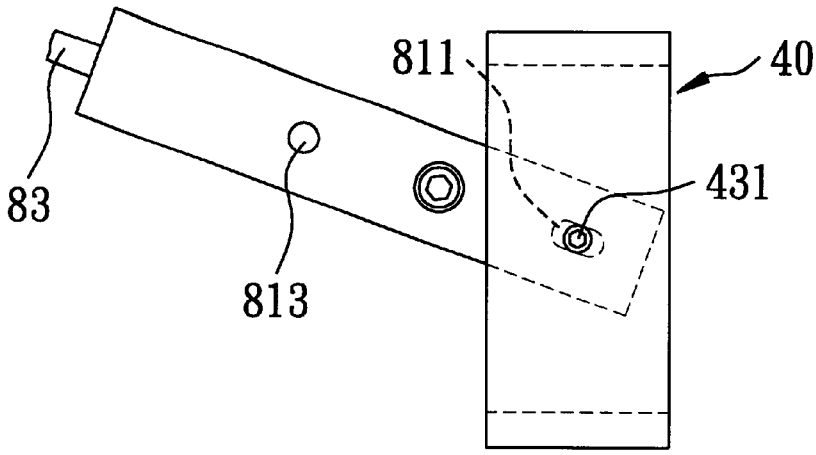

The operating lever 80 is movable between a retaining position, as best illustrated in FIGS. 8(A) and 8(B), where the protrusion 813 extends into the retention hole 732 in the seat 70 to prevent rotation of the lever 80 relative to the seat 70, and a disengaging position, as best shown in FIGS. 9(A),9(B) and 9(C), where the protrusion 813 of the lever 80 is removed from the retention hole 732 in the seat 70 so as to permit rotation of the lever 80 relative to the seat 70, which action further permits movement of the slide element 40 along the rod unit 17 via engagement of the engaging tongue 431 with a periphery that defines the slot 811 in the lever 80. Preferably, an urging member 821 is sleeved around the rivet 82, and urges the lever 80 against the seat 70 to prevent untimely removal of the protrusion 813 of the lever 80 from the retention hole 732 in the seat 70 (see FIG. 8(A)). A handle 83 is fixed to the lever 80 to facilitate removal of the protrusion 813 from the retention hole 732 and to assist pivotal action of the lever 80 on the lever-mounting seat 70.

The bevel gears 50,60 have axially extending tubular sleeves 52,62 which are inserted rotatably through holes 411,421 in the gear-holding arms 41,42 of the slide member 40 and which are formed with axially extending engaging grooves 502,602. The rod unit 17 has an axially extending groove 178 registered with the grooves 502,602 in the sleeves 52,62. A key 172 is inserted into the grooves (502,602,178) of the sleeves 52,62 and the rod unit 17 so as permit co-rotation of the gears 50,60 with the rod unit 17. A pair of biasing springs 54,64 are sleeved around the rod unit 17 and are retained on two opposite sides of the slide element 40 by means of C-shaped retaining clips 176,177 to prevent axial removal of the slide member 40 from the rod unit 17, and to retain consequently the bevel gears 50,60 on two opposite sides of the driving wheel 31, as best shown in FIG. 7.

Figure 12:
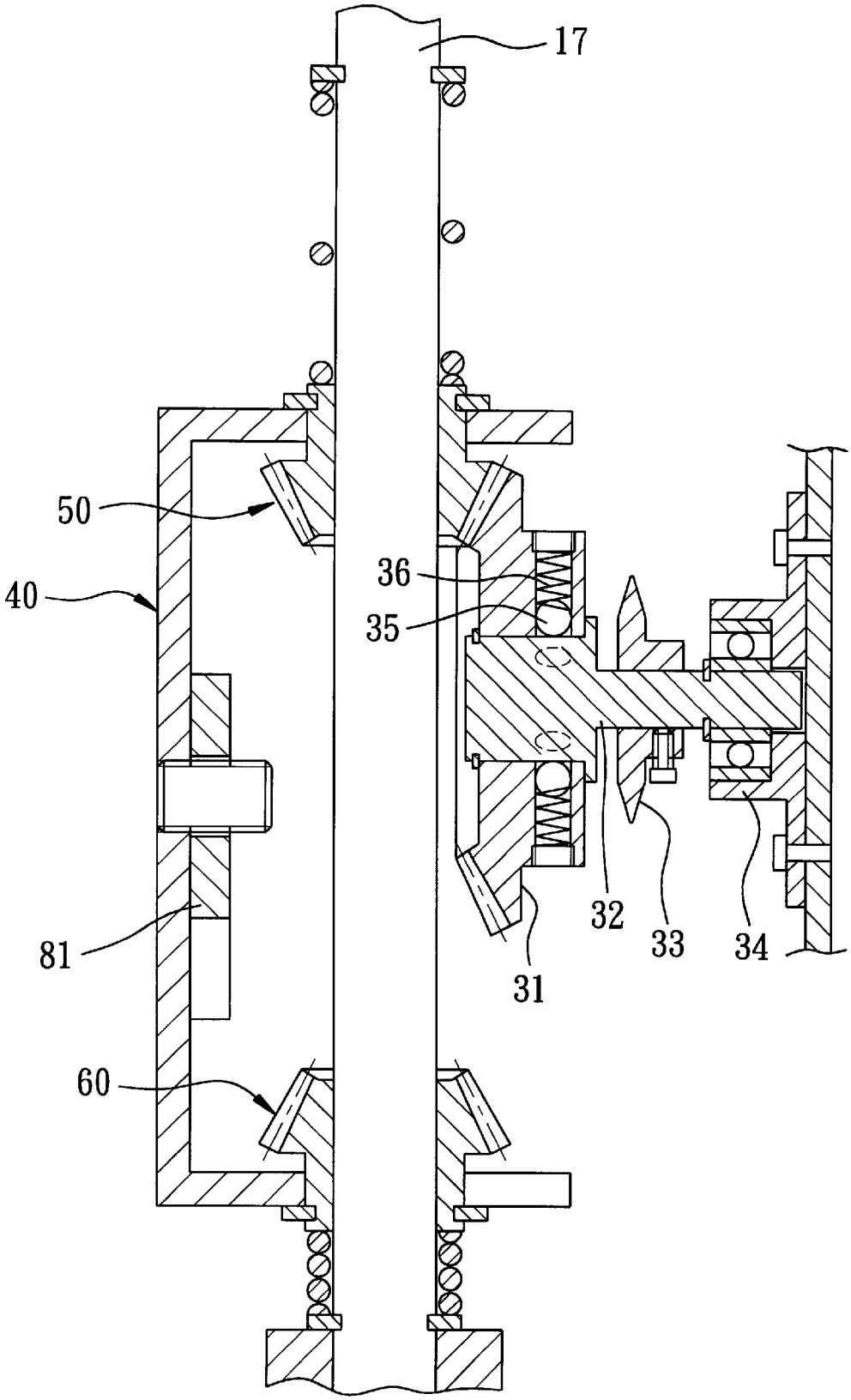
FIG. 12 is a fragmentary partly sectional view of the preferred embodiment, illustrating how a coupling shaft rotates idly with respect to the rod unit.

Referring again to FIGS. 5, 6 and 7, the transmission device 23 of the preferred embodiment is operably associated with a drive unit (not shown) that drives the cutter unit (not shown), and includes a plurality of chained wheels 231, a bearing seat 34 fixed on the right side wall 111 of the machine body 11, and a coupling shaft 32 that has an inner section 322 journalled to the bearing seat 34 and an outer section 321. A toothed wheel 33 is fixed on an intermediate section 323 of the coupling shaft 32 such that rotation of the toothed wheel 33 results in synchronous rotation of the coupling shaft 32. The driving wheel 31 is mounted on the outer section 321 of the coupling shaft 32 by spring-biased ball units 35,36 such that the driving wheel 31 co-rotates with the coupling shaft 32 to drive the first and second bevel gears 50,60 only when the bed 13 (see FIG. 1) is between lowermost and uppermost positions. In the event the bed 13 is moved to the uppermost position, continued rotation of the rod unit 17 and the bevel gear 50 is not possible, and the driving wheel 31 is prevented from rotation to permit idle rotation of the coupling shaft 32 relative to the driving wheel 31, as best shown in FIG. 12. A similar result occurs when the bed 13 is moved to the lowermost position, where continued rotation of the rod unit 17 and the bevel gear 60 is not possible. Since the mounting of the spring-biased ball units 35,36 between the driving wheel 31 and the coupling shaft 32 to result in releasable coupling therebetween is a known art, a detailed description of the same is omitted herein.

Since the user of the wood planing machine of the present invention can manually and mechanically, such as with the assistance of transmission device 23, operate the rod unit 17 to achieve the desired height adjustment of the bed 13 relative to the cutter unit, the aforesaid drawbacks encountered by the use of the prior wood planing machine can be avoided.

With this invention thus explained, it is apparent that numerous modifications and variations can be made without departing from the scope and spirit of this invention. It is therefore intended that this invention be limited only as indicated in the appended claims.

I claim:

1. A wood planing machine comprising:

a machine body;

a workpiece support bed disposed movably in said machine body; and a height adjustment mechanism including a bed-turning rod unit mounted on said machine body and operably associated with said support bed in such a manner that rotation of said rod unit results in movement of said support bed within said machine body, a slide element disposed slidably on said rod unit, having a pair of spaced apart gear-holding arms, and slidable along said rod unit between first and second positions, a transmission device mounted on said machine body, and having a toothed driving wheel exposed therefrom and disposed adjacent to said slide element, first and second bevel gears mounted respectively on said gear-holding arms of said slide element such that said first and second bevel gears are disposed on opposite sides of said driving wheel, said first and second bevel gears being coupled to said rod unit so as to be co-rotatable therewith, said slide element being movable to said first position, where said first bevel gear meshes with and is driven by said driving wheel to permit said rod unit to rotate in a first direction, and to said second position, where said second bevel gear meshes with and is driven by said driving wheel to permit said rod unit to rotate in a second direction opposite to said first direction.

2. The wood planing machine as defined in claim 1, wherein said slide element is formed with an engaging tongue disposed between said gear holding arms, said machine further comprising a lever-mounting seat which is fixed on said machine body and which is formed with a retention hole therein, and an operating lever which is pivoted to said seat and which has a protrusion projecting toward said retention hole and a slot for receiving said engaging tongue therein, said operating lever being movable between a retaining position, where said protrusion extends into said retention hole in said seat so as to prevent rotation of said lever relative to said seat, and a disengaging position, where said protrusion is removed from said retention hole in said seat so as to permit rotation of said lever relative to said seat, which action further permits movement of said slide element along said rod unit via engagement of said engaging tongue with a periphery that defines said slot.

* * * * *